United States Patent [19]

Seeley, Jr.

[11] Patent Number: 4,901,481

[45] Date of Patent: Feb. 20, 1990

[54] INFLATABLE SHELTER APPARATUS

[76] Inventor: Jesse R. Seeley, Jr., 404 State Rd., Eliot, Me. 03903

[21] Appl. No.: 274,344

[22] Filed: Nov. 21, 1988

[51] Int. Cl.[4] ..... E04H 15/20

[52] U.S. Cl. ..... 52/2 E

[58] Field of Search ..... 52/2 E, 2 K, 2 R, 2 J

[56] References Cited

U.S. PATENT DOCUMENTS

| | | | |
|---|---|---|---|
| 1,964,818 | 7/1934 | Hood | 52/2 K |
| 2,297,150 | 9/1942 | Hunter | 52/2 K |
| 2,754,836 | 7/1956 | Darby | 52/2 K |
| 2,812,769 | 11/1957 | Schaefer et al. | 52/2 E |
| 2,895,490 | 7/1959 | Dimond | 52/2 K |
| 3,999,333 | 12/1976 | Amarantos | 52/2 J |
| 4,197,681 | 4/1980 | Holcombe | 135/119 |
| 4,271,642 | 6/1981 | Karr | 135/93 |
| 4,295,302 | 10/1981 | Liu | 52/2 K |
| 4,335,545 | 6/1982 | Couch | 52/2 R |
| 4,384,435 | 5/1983 | Polise et al. | 52/2 J |
| 4,556,391 | 12/1965 | Tardivel et al. | 52/2 |

OTHER PUBLICATIONS

International Publication Number WO 86/00952, published 13 Feb. 1986, 3 shts. dwg., 5 pages spec.

*Primary Examiner*—James L. Ridgill, Jr.
*Attorney, Agent, or Firm*—Leon Gilden

[57] ABSTRACT

An inflatable shelter apparatus is set forth wherein a series of inflatable ribs are in fluid communication and association with an apex distribution valve for directing compressed air into the series of downwardly directed vertical ribs. Polymeric panels are secured about the exterior of the ribs to form an enclosure. The enclosure is secured at its base to an elongate planar sheet formed with apertures along the perimeter for securement of the shelter to a support surface. Each of the ribs is formed with at least a single one-way valve therein to prevent pneumatic discharge of all of the ribs upon leakage from a single rib.

7 Claims, 1 Drawing Sheet

INFLATABLE SHELTER APPARATUS

There are no related applications to provide a basis for the instant application as a divisional, continuation, or a continution-in-part application.

BACKGROUND OF THE INVENTION

1. Field of the Invention

The field of invention relates to portable shelters, and more particularly pertains to an inflatable shelter apparatus that may be compactly stored when not in use and may be further erected during periods of need.

2. Description of the Prior Art

The use of shelters of various types is well known in the prior art. The shelters of the prior art have heretofore failed to provide a compact organization of the type as set forth by the instant invention provided with safety valve mechanisms to prevent leakage of a pneumatic rib framework upon leakage of a single rib. For example, U.S. Pat. No. 4,384,435 to Polise sets forth an inflatable hemispherical tent wherein a manifold in the upper portion of the tent in communication reaches the sections, but as noted the Polise patent fails to provide safety valve means as set forth by the instant invention to prevent collapse of the structure upon perforation or leakage of one or more of the ribs therethrough and further fails to provide article suspension mechanisms within the tent to provide convenient support of articles throughout the interior of the tent.

U.S. Pat. No. 4,197,681 to Holcombe sets forth a plurality of inflatable opposed frame elements to provide a support structure for a tent or the like. The Holcombe patent is of the same deficiencies as other prior art in failing to provide safety mechanisms throughout the structure to prevent accidental deflation of the tent.

U.S. Pat. No. 4,271,642 to Karr sets forth a tent provided with inflatable tube framework and formed with a zippered closure flap for provision of a portable tent, but is of similar construction to prior devices of this category.

U.S. Pat. No. 4,295,302 to Liu sets forth an inflatable tent organization wherein a plurality of separately inflatable frameworks provides a skeleton network for support of a tent structure. A waterproof film formed to the framework provides a completed enclosure.

U.S. Pat. No. 4,335,545 to Couch sets forth an inflatable air cell provided with a plurality of elongate longitudinal cells which are formed with a rigid one-way valve structure therein, but fails to provide the plural valve structure as set forth by the instant invention and further fails to set forth the unique one-way valve structure set forth by the instant invention enabling a compact packaging of the shelter when not in use.

As such, it may be appreciated there continues to be a need for a new and improved inflatable shelter apparatus which overcomes the problems of storage and ease of use, and in this respect the present invention substantially fulfills this need.

SUMMARY OF THE INVENTION

In view of the foregoing disadvantages inherent in the known types of portable shelter apparatus now present in the prior art, the present invention provides an inflatable shelter apparatus wherein the same may be compactly stored when not in use and may be readily inflated for use when needed. As such, the general purpose of the present invention, which will be described subsequently in greater detail, is to provide a new and improved inflatable shelter apparatus which has all the advantages of the prior art portable shelters and none of the disadvantages.

To attain this, the present invention comprises a hemispherical shelter formed with an uppermost axially arranged distribution valve including a plurality of downwardly depending equally spaced radial ribs inflatable by means of the distribution valve. Each of the ribs includes at least one one-way valve that is also collapsible when not in use to provide a compact folded structure. Interiorly the tent is formed with a plurality of article suspension apparatus including a plurality of hooks positioned between each valve secured to an interior surface of a covering wall of the shelter and further including an elongate suspension flexible line for support of articles thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inflatable shelter apparatus which has all the advantages of the prior art inflatable shelter apparatus and none of the disadvantages.

It is another object of the present invention to provide a new and improved inflatable shelter apparatus which may be easily and efficiently manufactured and marketed.

It is a further object of the present invention to provide a new and improved inflatable shelter apparatus which is of a durable and reliable construction.

An even further object of the present invention is to provide a new and improved inflatable shelter apparatus which is susceptible of a low cost of manufacture with regard to both materials and labor, and which accordingly is then susceptible of low prices of sale to the consuming public, thereby making such inflatable shelter apparatus economically available to the buying public.

Still yet another object of the present invention is to provide a new and improved inflatable shelter apparatus which provides in the apparatuses and methods of the prior art some of the advantages thereof, while simultaneously overcoming some of the disadvantages normally associated therewith.

Still another object of the present invention is to provide a new and improved inflatable shelter apparatus provided with safety valve structure positioned within each of a series of framework ribs and further including article suspension means within the shelter for convenience of individuals utilizing the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
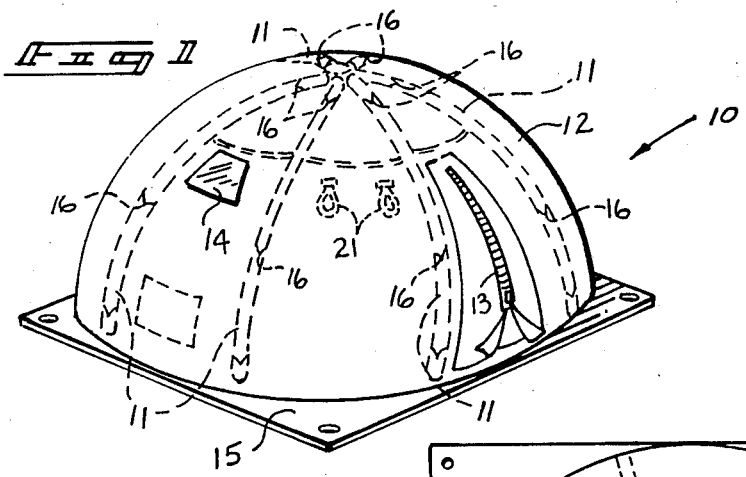
FIG. 1 is an isometric illustration of the instant invention.
Figure 3:
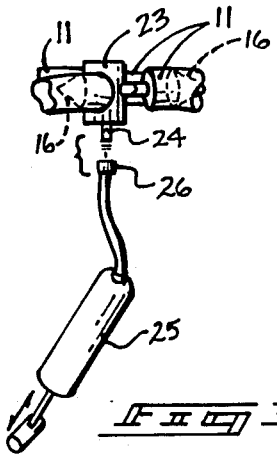
FIG. 3 is an isometric illustration of the distribution valve of the instant invention.
Figure 2:
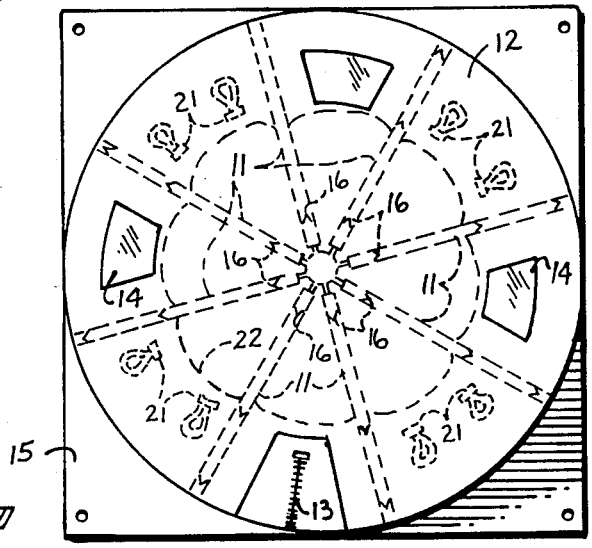
FIG. 2 is a top orthographic view of the instant invention.
Figure 4:
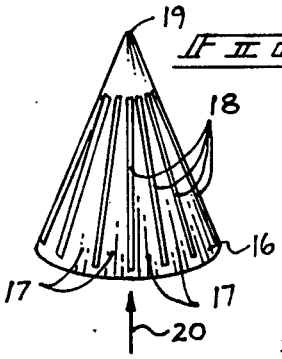
FIG. 4 is an isometric illustration of a typical valve utilized by the instant invention.
Figure 5:
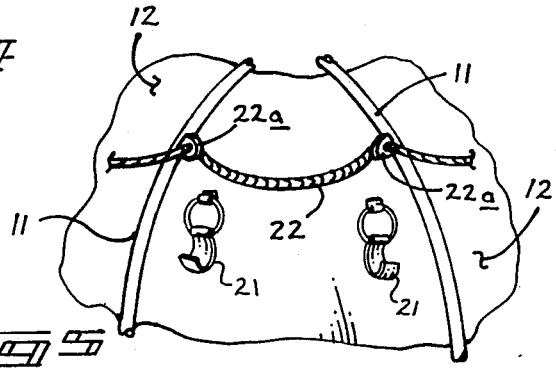
FIG. 5 is an isometric illustration of an interior surface of the tent and the associated hooks and support line therein.

With reference now to the drawings, and in particular to FIGS. 1 to 5 thereof, a new and improved inflatable shelter apparatus embodying the principles and concepts of the present invention and generally designated by the reference numeral 10 will be described.

More specifically, the inflatable shelter apparatus of the instant invention comprises a generally hemispherical shelter formed by a framework including a series of inflatable cells 11 radially directed about a surface of the shelter and merging towards the axis of the shelter apparatus 10 secured to an axially located distribution valve 23 including a downwardly directed Schrader-type valve 24. The valve 24 is formed with exterior threads to mate with a threaded coupler 26 of associated air pump 25. Accordingly upon directing pneumatic pressure through the valve 24 and associated distribution valve 23, the various inflatable cells 11 defining a skeleton framework for the associated shelter 10 will be inflated. The inflatable cells 11 include an overlying polymeric covering film 12. The film 12 may be of continuous construction or may include separate panels overlying and fixedly secured to the uppermost surface of each inflatable cell 11 utilizing heat seaming or adhesives and the like. The lowermost terminal periphery of the shelter 10 and associated film 12 is secured to a polymeric flexible base 15 formed with a series of apertures therethrough for securement of the base 15 to a support surface, such as the ground and the like. A plurality of transparent panels 14 may be utilized to direct light interiorly of the shelter 10 once erected.

Each inflatable cell 11 includes at least one one-way pneumatic conical valve 16. The at least one valve is positioned proximate the distribution valve 23 and thereby prevents leakage within one cell from affecting pneumatic pressure within the remaining cells. Desirably, a second one-way valve 16 is positionable medially of each cell 11 whereupon a cell losing pneumatic pressure due to leakage will not effect the entire cell thereby minimizing loss of structural integrity to the shelter 10 when erected.

Each one-way pneumatic conical valve 16 is of conical configuration with the apex or conical tip 19 directed away from the distribution valve with the base of the conical configuration directed towards the distribution valve or source of pneumatic pressure. The valve is constructed of a series of triangular flexible panels 17. The panels 17 are heat seamed or adhesively secured together and are formed with reinforcement strips 18 to maintain the conical configuration of the cell. The tip 19 of the valve is not heat seamed or secured together to provide an open tip whereupon pneumatic pressure directed from the direction of arrow 20 interiorly of the cavity of the conical configuration of the cell will be directed through the tip 19 whereupon the tip 19, due to the flexible construction of the various panels 17, will close and prevent pneumatic pressure from entering the tip and thereby maintain adjacent cells at pressurized levels not subject to the loss of pneumatic pressure within adjacent or companion cells.

Interiorly between adjacent cells 11 are formed and secured a plurality of "U" shaped hooks 21 within the interior surface of the shelter such that the hooks may secure and suspend articles therefrom. The hooks are utilized in pairs such that rigid elongate articles, such as fishing rods, firearms, and the like, may be suspended above the surface base 15 of the shelter. Further, an elongate continuous flexible line 22 is contained and maintained in position generally parallel to the base 15 and suspended by a series of cooperating loops **22*a* fixedly secured to each of the cells 11**.

It may be appreciated that the instant invention may therefore be compactly stored when not in use and provide for an easily manipulatable and handled package. The one-way valves are of a flexible and collapsible nature due to their construction of flexible panels and will upon deflation of the various cells, enable the cells to be flattened along with the one-way valves whereupon the entire organization may be rolled up into a cylinder defined exteriorly by the base 15.

The manner of usage and operation of the instant invention therefore should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable shelter apparatus defining a hemispherical shape comprising, a plurality of inflatable elongate cells defining a hemispherical surface of revolution, and a polymeric film fixedly secured to an exterior surface of said cells define a hemispherical covering, and a terminal lowermost peripheral edge of said covering fixedly secured to a flexible sheet to form an enclosure, said cells converging to a distribution valve, said valve positioned for directing pneumatic pressure to said cells, and at least one valve means contained within each cell for preventing deflation of companion cells upon pneumatic leakage from one or more of said cells, and wherein said valve means comprises at least one one-way valve positioned within each cell, and said valve means defining a conical configuration, and wherein the conical configuration includes a plurality of triangular flexible segments secured together to form said conical configuration and each of said triangular segments includes an elongate strip to impart configurational integrity to said one-way valve, and a tip defined by convergence of said triangular segments disposed in a normally open position upon directing pneumatic pressure from a base defined by said conical valve through said tip and disposed at a normally closed position preventing passage of pneumatic pressure directed exteriorly of said conical configuration toward said tip, and wherein a plurality of one-way valves are fixedly positioned within each cell to maintain integrity of each cell, and wherein a first one-way valve is positioned adjacent to the distribution valve and a second one-way valve is positioned medially of said elongate cell.

2. An inflatable shelter apparatus as set forth in claim 1 wherein said sheet extends beyond the terminal periphery of said film and is provided with a series of openings for securement of said sheet to a support surface.

3. An inflatable shelter apparatus as set forth in claim 2 wherein said distribution valve is positioned in an aligned relationship with an axis defining an axis of said hemispherical surface.

4. An inflatable shelter apparatus as set forth in claim 3 wherein said shelter apparatus is provided with a zippered entrance flap.

5. An inflatable shelter apparatus as set forth in claim 4 wherein a plurality of "U" shaped hooks are secured to an interior surface of said film between adjacent cells for securement of articles thereon.

6. An inflatable shelter apparatus as set forth in claim 5 wherein a continuous flexible line is secured interiorly of said shelter and is secured to each rib by passage through a loop wherein said loop is secured to each rib to suspend said line above said shelter.

7. An inflatable shelter apparatus as set forth in claim 6 wherein said distribution valve is provided with a threaded valve extension, and a manually manipulatable pump is threadedly securable to said valve extension for inflation of said cells.

* * * * *